US011149628B2

(12) United States Patent
Bucksey et al.

(10) Patent No.: US 11,149,628 B2
(45) Date of Patent: Oct. 19, 2021

(54) INTERNAL COMBUSTION ENGINES

(71) Applicant: Amaroq Limited, Stapleford (GB)

(72) Inventors: Christian Edward Bucksey, Haywards Heath (GB); Huw David Powell, Shoreham-by-Sea (GB)

(73) Assignee: Amaroq Limited, Stapleford (GB)

( * ) Notice: Subject to any disclaimer, the term of this patent is extended or adjusted under 35 U.S.C. 154(b) by 162 days.

(21) Appl. No.: 16/454,298

(22) Filed: Jun. 27, 2019

(65) Prior Publication Data

US 2019/0323419 A1 Oct. 24, 2019

Related U.S. Application Data

(63) Continuation of application No. 15/698,414, filed on Sep. 7, 2017, now abandoned.

(30) Foreign Application Priority Data

Sep. 12, 2016 (GB) ..... 1615413.0

(51) Int. Cl.
*F02B 25/06* (2006.01)
*F02B 1/12* (2006.01)
(Continued)

(52) U.S. Cl.
CPC ..... *F02B 25/06* (2013.01); *F02B 1/12* (2013.01); *F02B 25/14* (2013.01); *F02B 33/04* (2013.01);
(Continued)

(58) Field of Classification Search
CPC .. F02B 25/06; F02B 1/12; F02B 25/14; F02B 33/04; F02B 2075/025; F02B 9/02;
(Continued)

(56) References Cited

U.S. PATENT DOCUMENTS 2,265,677 A 12/1941 Constantine
4,240,381 A 12/1980 Lowther
(Continued)

FOREIGN PATENT DOCUMENTS

CN 103277219 A 9/2013
DE 102011003909 A 8/2012
(Continued)

OTHER PUBLICATIONS

GB Further Search Report dated Jun. 16, 2017 for GB Application No. GB1615413.0.
(Continued)

*Primary Examiner* — Logan M Kraft
*Assistant Examiner* — Susan E Scharpf
(74) *Attorney, Agent, or Firm* — EIP US LLP

(57) ABSTRACT

Disclosed is a piston ported two-stroke compression ignition internal combustion engine comprising: a cylinder having a fixed closed end, and a piston for reciprocation within the cylinder, wherein the closed end of the cylinder and the piston together define a combustion chamber therebetween; at least one heater to heat the combustion chamber; and a controller to control the heater to heat the combustion chamber when the controller determines that a temperature of the combustion chamber has fallen below a threshold temperature during reciprocation of the piston within the cylinder.

19 Claims, 5 Drawing Sheets

(51) Int. Cl.

| | |
|---|---|
| ***F02B 25/14*** | (2006.01) |
| ***F02B 33/04*** | (2006.01) |
| ***F02P 19/00*** | (2006.01) |
| ***F02P 15/00*** | (2006.01) |
| ***F02B 75/02*** | (2006.01) |
| ***F02F 7/00*** | (2006.01) |
| ***F23Q 7/00*** | (2006.01) |

(52) U.S. Cl.
CPC ..... *F02B 2075/025* (2013.01); *F02F 7/0036* (2013.01); *F02P 15/005* (2013.01); *F02P 19/00* (2013.01); *F23Q 7/001* (2013.01)

(58) Field of Classification Search
CPC . F02B 23/02; F02B 25/00; F02P 19/00; F02P 15/005; F02F 7/0036; F23Q 7/001
See application file for complete search history.

(56) References Cited

U.S. PATENT DOCUMENTS 4,312,307 A * 1/1982 Cooper ..... F02P 19/022 123/145 A
4,337,389 A * 6/1982 Bell ..... F23Q 7/001 123/179.21
4,430,967 A 2/1984 Williams
4,516,543 A * 5/1985 Abe ..... F02P 19/025 123/145 A
4,607,153 A * 8/1986 Ang ..... F02P 19/025 123/179.21
4,658,772 A * 4/1987 Auth ..... F02P 19/026 123/145 A
4,660,383 A 4/1987 Leonard
4,742,805 A 5/1988 Matsushita et al.
4,768,481 A 9/1988 Wood
4,920,932 A * 5/1990 Schlunke ..... F01L 1/38 123/65 PE
4,939,347 A * 7/1990 Masaka ..... F02P 19/022 123/179.6
5,119,780 A 6/1992 Ariga
5,195,486 A 3/1993 Ishii
5,241,929 A * 9/1993 Grassi ..... F02P 19/02 123/145 A
5,243,940 A * 9/1993 Gopel ..... F02D 19/0652 123/299
5,271,358 A * 12/1993 Katoh ..... F02M 69/045 123/73 PP
5,277,159 A 1/1994 Webster
5,327,870 A * 7/1994 Boisvert ..... F02P 19/02 123/145 A
5,367,994 A * 11/1994 Hinkle ..... F02P 19/026 123/145 A
5,669,349 A * 9/1997 Iwata ..... F01N 13/12 123/196 S
5,729,456 A * 3/1998 Boisvert ..... F02P 19/021 123/179.21
5,735,238 A * 4/1998 Russ ..... F01P 7/165 123/41.29
6,009,369 A * 12/1999 Boisvert ..... F02P 19/026 123/145 A
6,109,223 A * 8/2000 Motoyama ..... F02N 99/006 123/73 A
6,148,258 A * 11/2000 Boisvert ..... F02P 19/022 123/145 A
6,182,619 B1 2/2001 Spitzer et al.
6,286,482 B1 9/2001 Flynn
6,289,868 B1 9/2001 Jayne
6,659,071 B2 12/2003 Lapointe
7,150,262 B2 * 12/2006 Demura ..... F02D 35/023 123/305
7,449,994 B1 * 11/2008 Koerner ..... F02B 61/045 340/438
7,881,851 B2 * 2/2011 Kernwein ..... F02P 19/026 701/102
8,281,772 B2 * 10/2012 Kurtz ..... F02D 41/029 123/676
9,175,661 B2 * 11/2015 Kurtz ..... F02D 41/06
2005/0011486 A1 * 1/2005 Cueman ..... F02M 43/00 123/304
2005/0257769 A1 * 11/2005 Li ..... F02P 19/02 123/299
2007/0158946 A1 7/2007 Annen
2007/0158947 A1 7/2007 Annen
2007/0245818 A1 10/2007 Matekunas et al.
2008/0202465 A1 * 8/2008 Allen ..... F01M 1/16 123/196 R
2009/0151686 A1 6/2009 Nguyen
2011/0023819 A1 2/2011 Ives et al.
2011/0030628 A1 * 2/2011 Main ..... F16N 13/02 123/41.82 R
2011/0144882 A1 * 6/2011 Bidner ..... F01M 1/08 701/102
2012/0024275 A1 * 2/2012 Berneklev ..... F02B 25/14 123/73 A
2013/0152894 A1 * 6/2013 To ..... F02M 31/13 123/179.21
2014/0209057 A1 * 7/2014 Pouring ..... F02B 19/1023 123/257
2014/0338625 A1 11/2014 Fulton
2014/0379242 A1 * 12/2014 Henein ..... F02D 35/022 701/104

FOREIGN PATENT DOCUMENTS

| | | | |
|---|---|---|---|
| EP | 1293652 | A | 3/2003 |
| GB | 589988 | A | 7/1947 |
| GB | 2138073 | A | 10/1984 |
| GB | 2186323 | A | 8/1987 |
| GB | 2428741 | A | 2/2007 |
| KR | 10 20120013132 | A | 2/2012 |

OTHER PUBLICATIONS

GB Search Report dated Mar. 10, 2017 for GB Application No. GB1615413.0.
Extended European Search Report dated Jul. 3, 2018 for EP Application No. 17196933.0.

* cited by examiner

INTERNAL COMBUSTION ENGINES

CROSS-REFERENCE TO RELATED APPLICATIONS

This application is a continuation of U.S. application Ser. No. 15/698,414, filed Sep. 7, 2017, which claims priority to GB Application No. GB 1615413.0, filed Sep. 12, 2016, under 35 U.S.C. § 119(a). Each of the above-referenced patent applications is incorporated by reference in its entirety.

FIELD OF THE INVENTION

This invention relates to internal combustion engines. More particularly, the invention relates to piston ported two-stroke internal combustion engines.

BACKGROUND OF THE INVENTION

A cylinder of a typical high speed two-stroke internal combustion engine has a closed end, and a combustion chamber is formed between a reciprocating piston and the closed end. The piston drives a crankshaft via a connecting rod. Intake air and exhaust gas pass to and from the combustion chamber via ports in the cylinder, which are opened and closed by the piston passing over them. During operation of the engine, intake air passes into the cylinder via at least one intake port in the cylinder wall that is opened and closed by the piston. Gasoline is introduced into the cylinder, and the fuel/air mixture is spark ignited at or close to the point in the engine cycle where the piston is closest to the closed end of the cylinder and the combustion chamber volume is at its smallest. Pressure increases in the cylinder, driving the piston away from the closed end of the cylinder. The linear motion of the piston is turned into rotating motion via a connecting rod and crankshaft arrangement. A casing below the piston, which casing contains the connecting rod and crankshaft, may be sealed to allow intake air to be pumped using the crankcase side of the piston motion. As the piston continues to travel within the cylinder away from the closed end, it uncovers at least one exhaust port in the cylinder wall through which exhaust gases are expelled. On returning towards the closed end, the piston passes the intake port or ports again, the charge of intake air purges the cylinder of exhaust gases, and the two-stoke cycle repeats.

SUMMARY OF THE INVENTION

Gasoline-fueled two-stroke internal combustion engines, such as that discussed above, may be lightweight and power-dense. It is for at least this reason that it is common to use gasoline-fueled two-stroke internal combustion engines in lightweight applications, such as outboard marine engines. Using fuel oil in place of gasoline can enable improved fuel efficiency and improved fuel safety. However, spark igniting fuel is problematic when fuel oil is used in place of gasoline, because spark plug fouling by the fuel spray reduces the efficiency and durability of the engine. Known oil-fueled four-stroke compression ignition internal combustion engines offer relatively low power density or are complex. Moreover, known oil-fueled two-stroke internal combustion engines are heavy, have a complex architecture, or have complex operation.

There is a need for relatively simple, safe, efficient, and compact engines that offer a high ratio of power output to weight, offer relatively clean fuel burn, and are suitable for use in lightweight applications.

The present invention is predicated on findings by the inventors of ways to enable the reduction in weight and/or complexity of internal combustion engines. In some embodiments, there need not be sacrifices in terms of power output to weight, running speed, fuel efficiency, cleanliness of fuel burn, and/or fuel safety.

The present invention is concerned with piston ported two-stroke internal combustion engines in which, in use, fuel oil is injected directly into the combustion chamber and compression ignited.

A first aspect of the present invention provides a piston ported two-stroke compression ignition internal combustion engine comprising a cylinder having a fixed closed end, and a piston for reciprocation within the cylinder, wherein the closed end of the cylinder and the piston together define a combustion chamber therebetween; and at least one heavy fuel oil injector, the injector having a nozzle that is positioned within the combustion chamber and through which heavy fuel oil is expelled directly into the combustion chamber in use.

By physically locating the nozzle within the combustion chamber to effect direct injection, as opposed to within a pre-chamber, the engine of the present invention has a simpler construction, improved fuel injection, and improved air motion and combustion characteristics. The engine also is compatible with the use of multi-point injection using a fuel oil direct injection injector, and particularly a high pressure such injector.

The injector nozzle will typically be at one end of the injector, which is the end of the injector that projects into the cylinder. The nozzle may protrude outwardly from an end face of a housing of the injector into the combustion chamber.

In some embodiments, in use, the fuel oil is injected into the combustion chamber at or close to the point in the engine cycle when the piston and the closed end of the cylinder are at their closest and the combustion chamber volume is thus at its smallest.

The injector nozzle may have a plurality of spaced-apart apertures around its periphery from which the heavy fuel oil is expelled generally radially into the combustion chamber in use. There may be a valve, such as a needle valve, in the nozzle that is operable to control a pressurized supply of fuel oil to the apertures. The supply of high pressure fuel oil may be controlled in a conventional manner.

The injector may be an electrically powered injector. The engine may comprise a controller to control the injector to effect multi-point injection.

The injector may be a high pressure direct injection injector.

The fuel may be supplied to the injector using an electronically (ECU) controlled high pressure fuel pump pressurizing a reservoir (rail) that in turn feeds the fuel injector high pressure fuel on demand. This system is generically known as common rail. Alternatively, a cam may actuate a high pressure pumping chamber in the injector. These type of high pressure systems enable multi-point fuel injection. That is, the injector is able to respond fast enough to deliver multiple fuel injections into the combustion chamber during a single cylinder compression event. Fuel may be delivered to the injector at up to about 3,000 bar, such as between 250 bar and 1,500 bar. Multi-point fuel injection can help result in high atomization of fuel leaving the nozzle, improved ignition of fuel, cleaner combustion, and/or quieter running of the engine, without the need for a pre-chamber or the use of a relatively high compression ratio. As would be understood by the skilled person, a pre-chamber or pre-combustion-chamber is a space that is auxiliary to a main combustion chamber and in which mixing of fuel and a compressed intake charge and combustion are initiated, ahead of the main combustion chamber where bulk of combustion takes place.

The injector may project into the cylinder from the closed end of the cylinder. The injector may project into the combustion chamber along an axis that is coincident with, or parallel to, a central axis of the cylinder.

The injector may be fixed relative to the cylinder to locate the nozzle in a fixed position that is within the combustion chamber throughout the engine cycle. Accordingly, the nozzle may be within the combustion chamber at the point in the engine cycle when the combustion chamber volume is at its smallest.

The injector may be cooled in use. For example, a housing of the injector may be cooled by a supply of a coolant fluid, which may be the fuel itself in some embodiments.

The engine may comprise at least one heater to heat the combustion chamber. The heater is usable to aid compression ignition of fuel oil in the combustion chamber, in use. The heater may, for example, be a glow plug. At least a portion of the heater may be positioned within the combustion chamber. Benefits of providing such a heater are discussed below.

The present invention is also concerned with piston ported two-stroke internal combustion engines with a heater to aid compression ignition of fuel oil in the combustion chamber in use.

A second aspect of the present invention provides a piston ported two-stroke compression ignition internal combustion engine comprising a cylinder having a fixed closed end, and a piston for reciprocation within the cylinder, wherein the closed end of the cylinder and the piston together define a combustion chamber therebetween; and at least one heater to heat the combustion chamber, wherein at least a portion of the heater is positioned within the combustion chamber.

The heater may be used to supplement the heat generated by engine compression to help ignite the fuel oil. The heater may be used as a fuel oil ignition aid, when the duty of the engine does not provide sufficient heating from compression to cleanly ignite the fuel oil. Heat emitted by the heater in use adds energy to the compression ignition process, so as to help lower the compression ratio required for ignition of the heavy fuel oil. Example circumstances are when starting the engine from cold, or when the ambient temperature is too low to sustain suitable in-cylinder engine temperature for efficient combustion.

The heater of the present invention allows the compression ratio to be relatively low whilst maintaining clean fuel oil burn, by adding additional heat to attain good combustion of the fuel oil in the absence of sufficient compression alone for efficient fuel oil ignition. The compression ratio may, for example, be less than or equal to 15:1. Therefore, the structure of the engine can be lightened because it does not have to withstand the higher compression ratios that would be required without such a heater. However, it will be appreciated that in other embodiments the compression ratio may be higher than 15:1, such as up to 20:1 or up to 25:1.

In embodiments in which the engine has such a heater, the engine may also comprise a controller to control the heater. The controller may control the heater to heat the combustion chamber, when the controller determines that a temperature of the combustion chamber has fallen below a threshold temperature during reciprocation of the piston within the cylinder. This is in contrast to starting the engine from cold, when the temperature of the combustion chamber has not fallen below the threshold temperature actually during reciprocation of the piston within the cylinder, i.e. during operation of the engine.

The present invention is also concerned with piston ported two-stroke internal combustion engines with a heater that is controlled, in use, to re-establish, during engine operation, a temperature in the combustion chamber sufficient for, or to aid, compression ignition of fuel oil.

A third aspect of the present invention provides a piston ported two-stroke compression ignition internal combustion engine comprising a cylinder having a fixed closed end, and a piston for reciprocation within the cylinder, wherein the closed end of the cylinder and the piston together define a combustion chamber therebetween; at least one heater to heat the combustion chamber; and a controller to control the heater to heat the combustion chamber when the controller determines that a temperature of the combustion chamber has fallen below a threshold temperature during reciprocation of the piston within the cylinder.

Subjecting the combustion chamber to additional heat from the heater at only selected or controlled times, as opposed to, say, thermally-insulating the combustion chamber with a material having high heat retention ability, helps to reduce or avoid overly-high combustion temperatures that could otherwise result in high NOx emissions.

In embodiments in which the engine has such a controller, the engine may further comprise a sensor to detect a characteristic that is indicative of the temperature of the combustion chamber during reciprocation of the piston within the cylinder, and to output a signal in dependence on the characteristic detected. The controller may be configured to determine whether the temperature of the combustion chamber has fallen below the threshold temperature during reciprocation of the piston within the cylinder, on the basis of this signal.

In embodiments in which the engine has such a heater, the heater may project into the combustion chamber from the closed end of the cylinder.

The heater may be an electrically powered heater, a glow plug, or any other heater for heating the combustion chamber during engine operation, i.e. during reciprocation of the piston within the cylinder.

In the engines of the first to third aspects of the invention discussed above, the injector and/or the heater is present as discussed above. However, in some embodiments, the engine is provided without the injector and/or the heater but is configured to receive the injector and/or the heater, respectively, in use.

A fourth aspect of the present invention provides a piston ported two-stroke compression ignition internal combustion engine comprising a cylinder having a fixed closed end, and a piston for reciprocation within the cylinder, wherein the closed end of the cylinder and the piston together define a combustion chamber therebetween; at least one injector mount for holding a heavy fuel oil injector with a nozzle of the injector positioned within the combustion chamber so that heavy fuel oil is expellable through the nozzle directly into the combustion chamber in use; and a supply for supplying heavy fuel oil to the injector when the injector is held by the injector mount.

A fifth aspect of the present invention provides a piston ported two-stroke compression ignition internal combustion engine comprising a cylinder having a fixed closed end, and a piston for reciprocation within the cylinder, wherein the closed end of the cylinder and the piston together define a combustion chamber therebetween; at least one heater mount for holding a heater to heat the combustion chamber with at least a portion of the heater positioned within the combustion chamber; and an interface for connecting the heater to a power source when the heater is held by the heater mount. The interface may be for electrically connecting the heater to an electrical power source.

The engine may comprise a controller to control the heater, when the heater is held by the heater mount, to heat the combustion chamber when the controller determines that a temperature of the combustion chamber has fallen below a threshold temperature during reciprocation of the piston within the cylinder.

A sixth aspect of the present invention provides a piston ported two-stroke compression ignition internal combustion engine comprising a cylinder having a fixed closed end, and a piston for reciprocation within the cylinder, wherein the closed end of the cylinder and the piston together define a combustion chamber therebetween; at least one heater mount for holding a heater to heat the combustion chamber; and a controller to control the heater, when the heater is held by the heater mount, to heat the combustion chamber when the controller determines that a temperature of the combustion chamber has fallen below a threshold temperature during reciprocation of the piston within the cylinder.

The engine of any of the above described aspects of the invention may comprise a crankshaft that is held by at least one bearing, and that is operatively connected to the piston so as to be driven by reciprocating motion of the piston. The engine may further comprise at least one lubrication path via which the heavy fuel oil travels to lubricate the at least one bearing. The at least one lubrication path and the injector of the engine, when provided, may be fluidly connected to a common supply of the heavy fuel oil.

Whilst a single cylinder piston ported two-stroke internal combustion engine with compression ignition configuration is possible, engines in accordance with some embodiments of the invention comprise plural cylinders, for example two cylinders, four cylinders, six cylinders, eight cylinders or more.

When plural cylinders are used, various configurations are possible that may offer different benefits in terms of balance of forces, overall shape and size of the engine, etc. Configurations include (but are not limited to) 'straight' configurations with all of the cylinders side-by-side, 'V' configurations, pairs of cylinders (e.g. 'flat two', 'flat four', etc.), 'U' configurations with two straight banks of cylinders side-by-side (e.g. 'square four'), and 'W' configurations (i.e. two adjacent banks of 'V' configured cylinders) and radial configurations. Depending on the configuration, the plural cylinders may drive a single crankshaft or a plurality of crankshafts.

In some embodiments, the engine has a power output of up to 150 horsepower, such as between 10 and 120 horsepower, between 25 and 75 horsepower or between 30 horsepower and 60 horsepower. In some embodiments, the engine has a power output of between about 5 and 30 horsepower per cylinder, or between 10 and 20 horsepower per cylinder. In some embodiments, such as those with six or eight cylinders, the power output could be higher, such as up to but not limited to 300 horsepower.

In some embodiments, the engine is an outboard marine engine.

The controller of the engine of any of the above described aspects may comprise an engine control unit (ECU) that is programmed or otherwise configured to control the heater as described.

A seventh aspect of the present invention provides a non-transitory machine-readable storage medium storing instructions that, when executed by a controller of a piston ported two-stroke compression ignition internal combustion engine, the engine comprising a cylinder having a fixed closed end, a piston for reciprocation within the cylinder, wherein the closed end of the cylinder and the piston together define a combustion chamber therebetween, and at least one heater to heat the combustion chamber; and the controller to control the heater to heat the combustion chamber, causes the controller to determine whether a temperature of the combustion chamber has fallen below a threshold temperature during reciprocation of the piston within the cylinder; and control the heater to heat the combustion chamber when the controller determines that the temperature of the combustion chamber has fallen below the threshold temperature during reciprocation of the piston within the cylinder.

An eighth aspect of the present invention provides an engine control unit (ECU) comprising the non-transitory machine-readable storage medium of the seventh aspect of the invention.

BRIEF DESCRIPTION OF THE DRAWINGS

Embodiments of the invention will now be described by way of example only, with reference to the accompanying drawings in which:

in FIG. 2(*b*) the piston is traveling downwards from TDC and has opened the exhaust port; in FIG. 2(*c*) the piston is traveling further downwards and is just opening the intake port; and in FIG. 2(*d*) the piston is traveling upward towards TDC, has closed the intake port, is about to close the exhaust port, and is drawing intake air into the crankcase through a reed valve.

DETAILED DESCRIPTION OF CERTAIN INVENTIVE EMBODIMENTS

Figure 1:
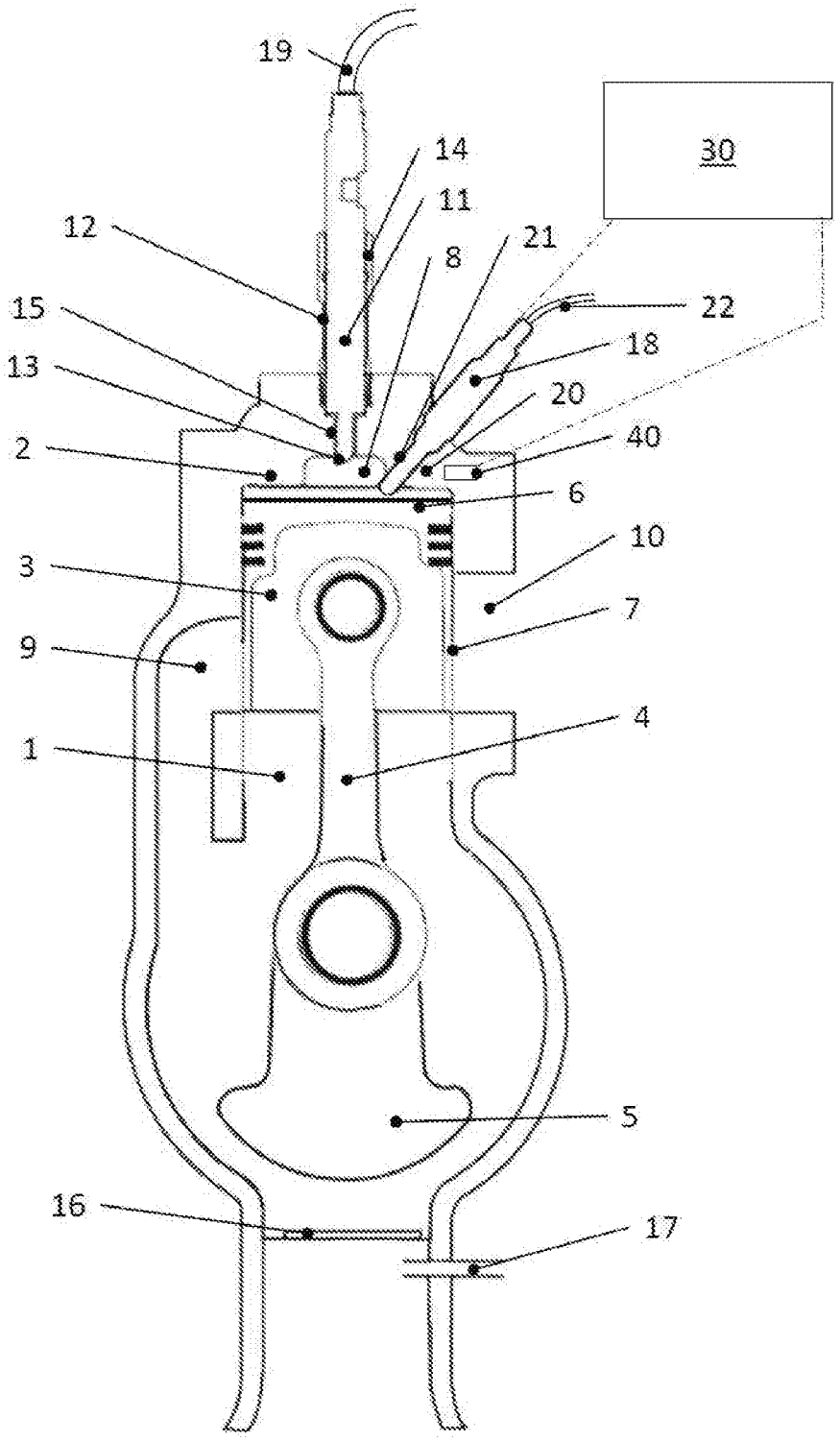
FIG. 1 is a cross-section through an outboard marine engine according to an embodiment of the present invention.
Figure 2A:
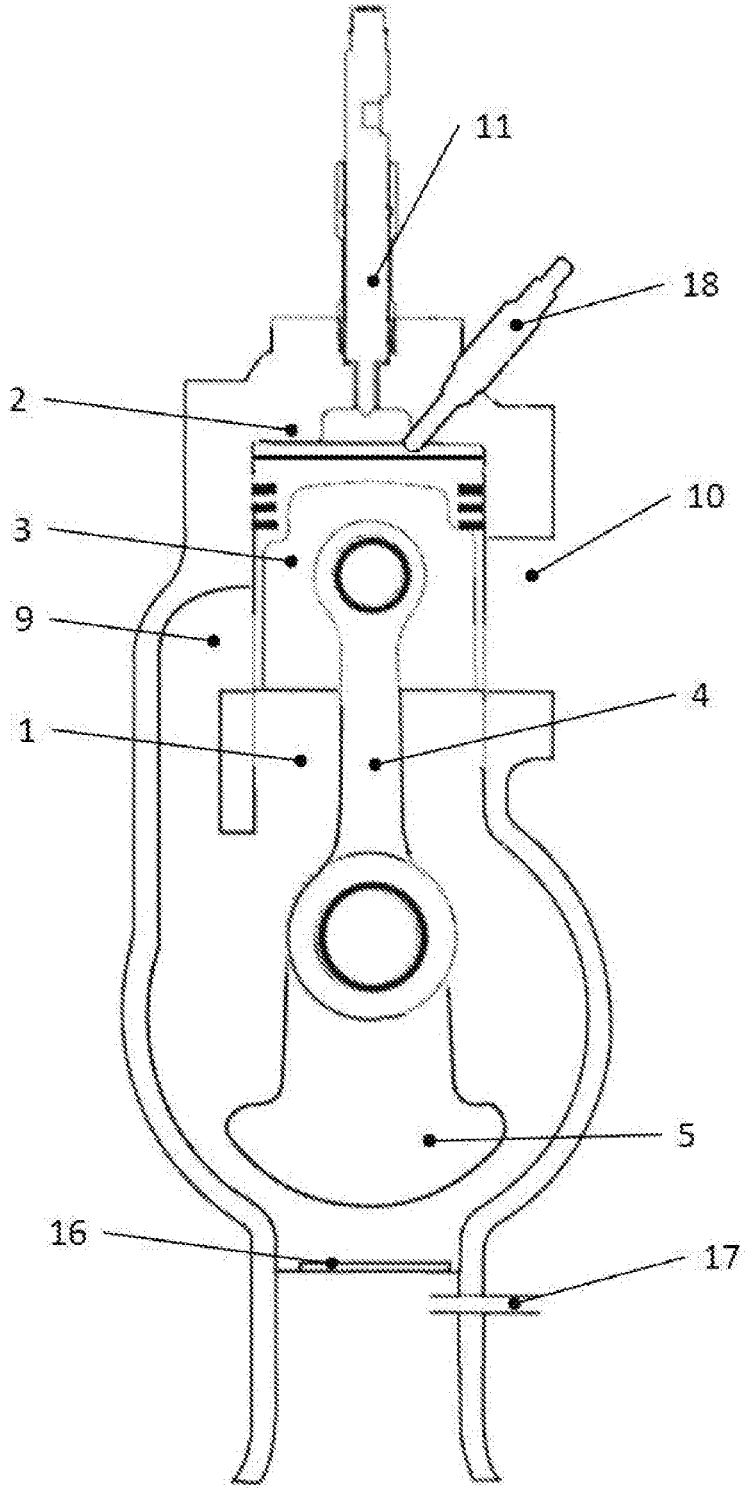
FIGS. 2(*a*) to 2(*d*) show snapshots of the engine of FIG. 1 through one complete revolution of the crankshaft in which, in FIG. 2(*a*) the piston is at top dead center ('TDC') with the combustion chamber volume at its minimum.
Figure 2B:
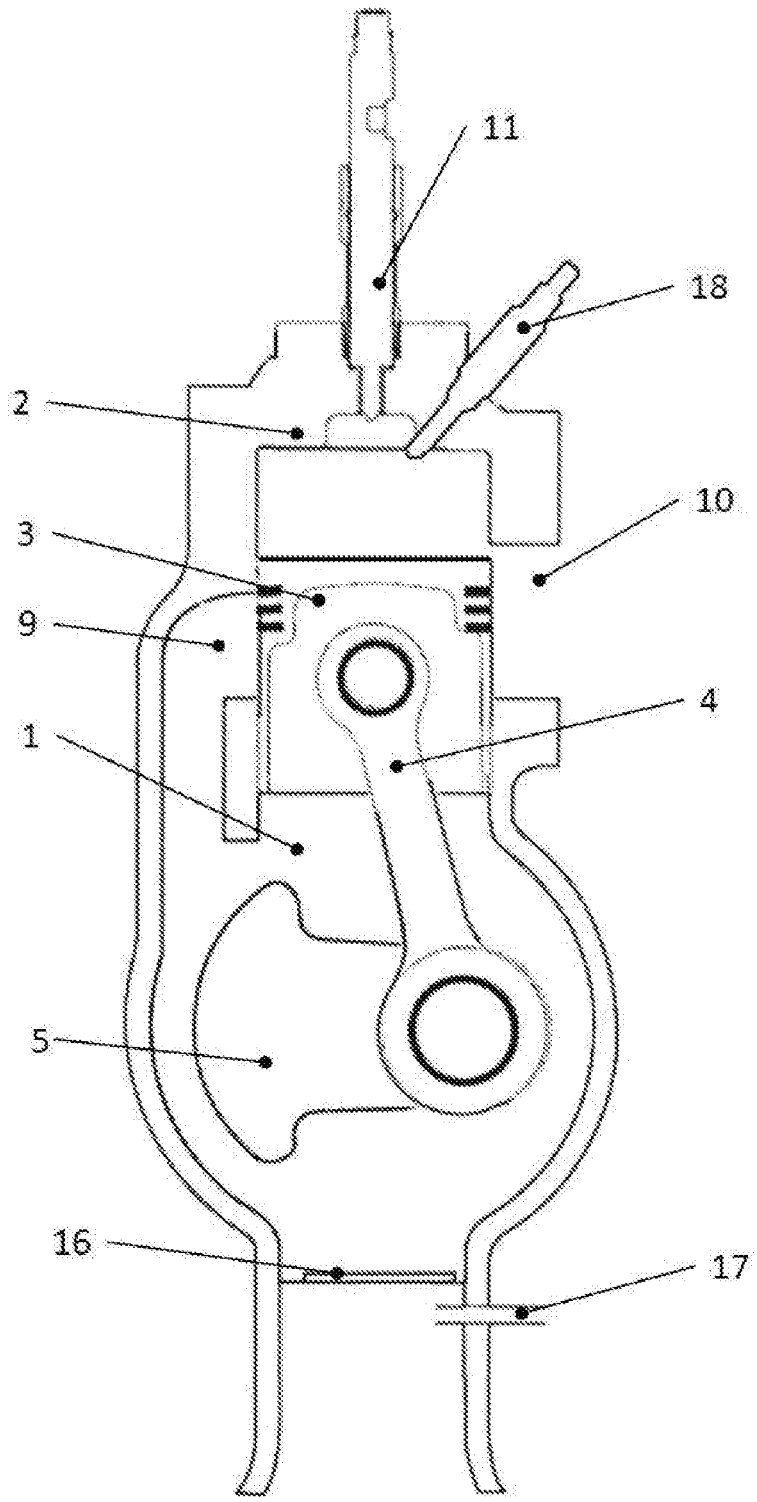
Figure 2C:
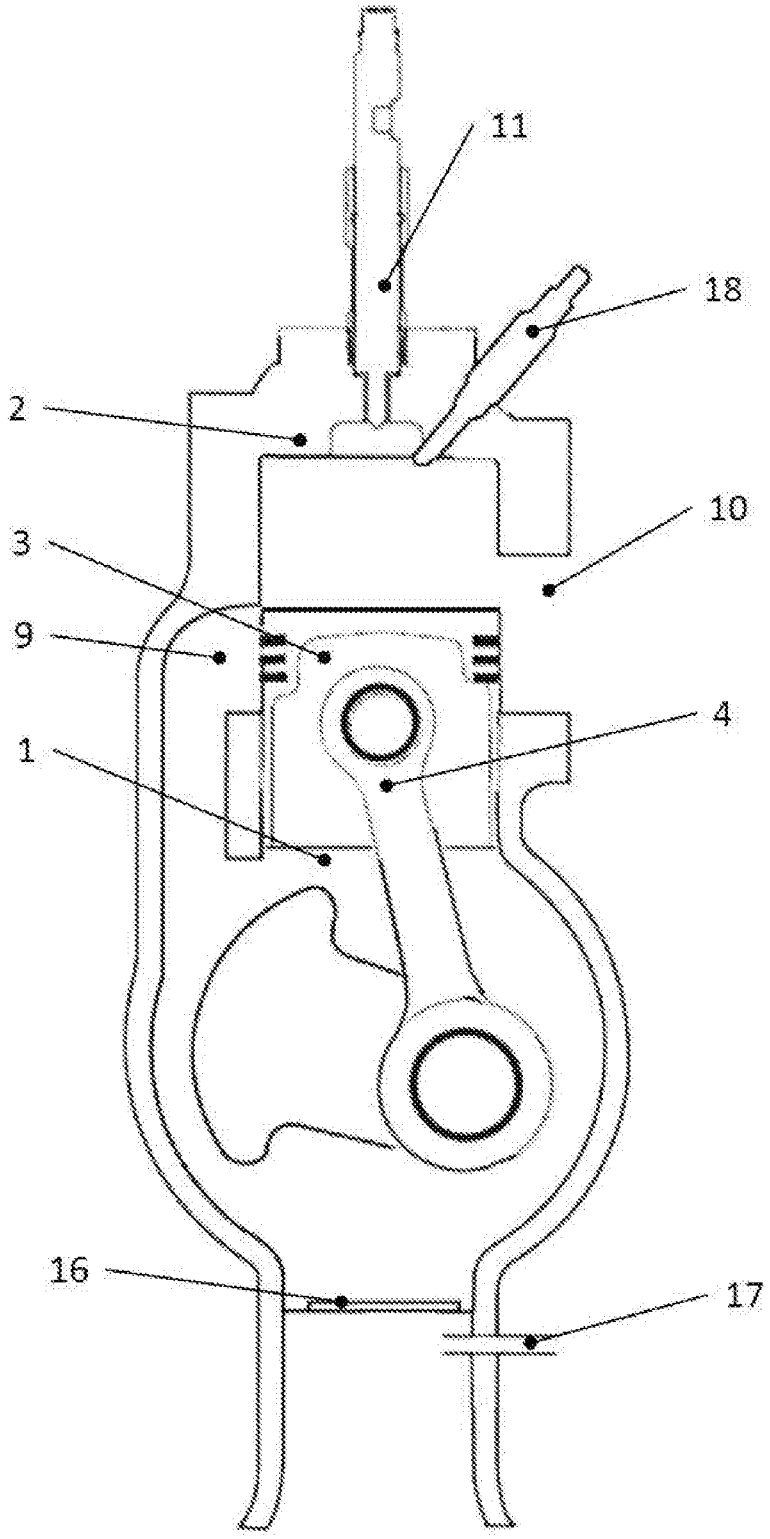
Figure 2D:
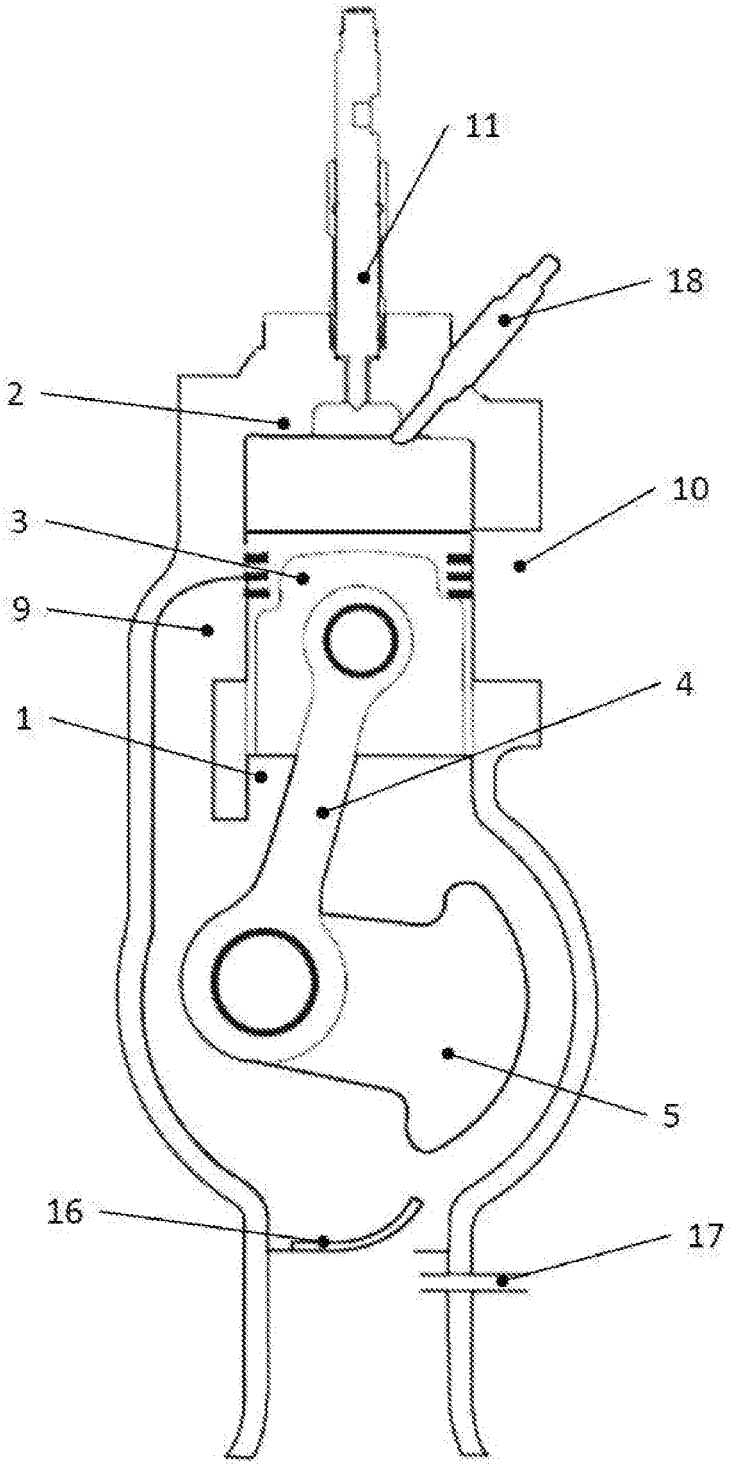

The embodiment used here to exemplify the invention is a piston ported two-stroke single cylinder internal combustion engine with compression ignition, direct fuel oil injection and a heater 18 in the form of a glow plug. The engine is configured with one horizontal cylinder 1 and a vertical crankshaft 5, in use. As best seen in FIG. 1, this configuration provides the engine with a low-profile overall envelope that will be advantageous for some applications. Indeed, in this embodiment, the engine is an outboard marine engine. Engines in accordance with embodiments of the invention can also be used as propulsion or power generation units for other marine applications, as well as for land vehicles and aircraft. Although not shown, in other embodiments the engine may comprise plural cylinders, for example two cylinders, four cylinders, six cylinders, eight cylinders or more. When provided, such plural cylinders may be in any one of the configurations discussed above. In some embodiments, the cylinder(s) may be horizontally oriented and the crankshaft vertically oriented or one or both of the cylinder(s) and the crankshaft may be inclined to the vertical and/or horizontal, such as when there are plural cylinders arranged in a V configuration.

In more detail, looking initially at FIG. 1, the engine comprises a cylinder 1 that has a fixed closed end 2. The closed end 2 is at the end of the cylinder 1 furthest from the crankshaft 5. In this embodiment, the cylinder 1 is closed at the end 2 by a cylinder head that is integral with the cylinder 1, in an arrangement often referred to as a mono block. In other embodiments, cylinder head may be detachable, or the fixed closed end 2 of the cylinder may be provided by a different closing feature that is fixed relative to the cylinder 1, such as a piston fixed in the bore of the cylinder 1.

The engine further comprises a piston 3 for reciprocation within the cylinder 1 and for driving a connecting rod 4 that, in turn, rotates the crankshaft 5. The closed end 2 of the cylinder 1 and the piston 3 together define a combustion chamber 8 therebetween, into which heavy fuel oil is injected in use. The piston 3 is the only piston for reciprocation within the cylinder 1.

The piston 3 of this embodiment has a crown 6 and a skirt 7 depending from the crown 6. The piston crown 6 faces the closed end 2 of the cylinder 1. In this example, the crown 6 of the piston 3 is substantially flat, whereas the closed end 2 of the cylinder 1 has an annular depression with a generally tear-drop shaped cross-section. At top dead center, when the piston crown 6 and closed end 2 of the cylinder 1 are closest to each another (and very nearly touching), the combustion chamber 8 defined by the piston 3 and the closed end 2 is a toroidal combustion chamber 8. In other embodiments, the combustion chamber 8 may have a shape other than toroidal, such as cylindrical or substantially cylindrical.

When the piston 3 and the closed end 2 of the cylinder 1 are at a position in the engine cycle where they are spaced furthest from one another to define a maximum contained volume within the cylinder ("bottom dead center", or "BDC"), the piston 3 is withdrawn sufficiently far from the closed end 2 to uncover intake ports 9 and exhaust ports 10 that extend through the cylinder wall. In other embodiments, the engine may have only one intake port 9 and/or only one exhaust port 10 extending through the cylinder wall. In this embodiment, the intake ports 9 are aligned partially tangentially relative to the cylinder wall. As the piston 3 moves towards the closed end 2 of the cylinder 1 in the compression stroke of the engine cycle, the piston skirt 6 covers and closes the ports 9, 10. As seen in FIG. 2(*d*), the exhaust ports 10 have a greater axial extent (i.e. dimension in the direction of the longitudinal axis of the cylinder 1) than the intake ports 9. Therefore, the exhaust ports 10 open sooner than, and stay open longer than, the intake ports 9, in use to aid scavenging of the cylinder 1.

In this embodiment, the engine does not have any poppet valves. That is, the engine is free of poppet valves. Packaging poppet valves and a fuel injector in a cylinder head disadvantageously limits how small the size of the bore of the cylinder can be. In embodiments of the present invention, omitting poppet valves enables the bore size to be reduced, which could be advantageous for small utility engines, can help reduce the weight of the engine, and may aid fuel saving.

Associated with the cylinder 1 is a heavy fuel oil injector 11. The injector 11 has a nozzle 13 that is positioned within the combustion chamber 8 and through which heavy fuel oil is expelled or injected directly into the combustion chamber 8 in use. The engine of this embodiment has no pre-chamber. The injector 11 has a cylindrical housing 12 and the injector nozzle 13 is at one end of the housing 12. Heavy fuel oil is supplied under pressure to the nozzle 13 in use, through the injector housing 12. The nozzle 13 projects from an end face of the injector housing 12 into the combustion chamber 8, and has a plurality of spaced-apart apertures around the periphery of the nozzle 13, through which the heavy fuel oil is expelled in a generally radial direction into the combustion chamber 8 in use. The nozzle 13 is opened and closed by a needle valve (not shown). When the needle valve is open, fuel oil is injected under pressure through the apertures and into the combustion chamber 8. The opening and closing of the needle valve can be controlled in a conventional manner, such as by use of an electronically-controlled common rail. Fuel pressure and volume in the rail may be controlled electronically via control valves in the fuel pump and the rail, and the fuel delivery time may be electronically controlled at the injector 11. In use, the injector housing 12 may be cooled by a supply of a coolant fluid, which may be the fuel oil itself.

FIG. 1 shows the injector 11 projecting into the combustion chamber 8 from the closed end 2 of the cylinder 1 and along an axis that is coincident with a central axis of the cylinder 1. In other embodiments, the orientation and location of the injector 11 may be different to that shown, to aid the combustion geometry and package envelope of the engine. For example, in some examples, the injector 11 may project into the combustion chamber 8 along an axis that is parallel with the central axis of the cylinder 1. In some embodiments, the injector 11 may project into the combustion chamber 8 from other than the closed end 2 of the cylinder 1.

In this example, the injector 11 is fixed to an injector mount 14 at the closed end 2 of the cylinder 1, so as to be held by the mount 14. The injector 11 is held by the mount 14 so as to extend through an opening 15 in the closed end 2 of the cylinder 1 to locate the nozzle 13 in the combustion chamber 8 in the position discussed above and as shown in FIG. 1. The injector 11 is fixed relative to the cylinder 1 to locate the nozzle 13 in a fixed position that is within the combustion chamber 8 throughout the engine cycle. Therefore, when the piston 3 is at top dead center, the nozzle 13 of the fuel oil injector 11 is directly within the combustion chamber 8 and fuel can be injected laterally from the nozzle 13 into the combustion chamber 8 via the spaced-apart apertures of the nozzle 13. The engine has a supply 19, in this embodiment in the form of a pipe, for supplying heavy fuel oil to the injector 11 when the injector 11 is held by the mount 14, as shown in FIG. 1.

The fuel injector 11 itself can be of conventional construction. The heavy fuel oil spray may take the form of a plurality of radial jets spaced around a nozzle 13 of the injector 11 and controlled by a single valve arrangement, such as a needle valve arrangement comprising a needle and seat that the needle engages to close the valve. The fuel injector 11 may, for example, be a conventional injector housed in a sleeve. In this arrangement, the nozzle 13 of the conventional injector 11 would protrude from one end of the sleeve. The injector 11 may be surrounded by a coolant within the sleeve. Alternatively, a bespoke injector 11 may be used, which may be cooled, although the internal components of the injector 11 may still be conventional.

In this embodiment, the injector 11 is an electrically powered injector 11. Moreover, the engine has a controller 30 to control the injector 11 to effect multi-point injection. The injector 11 is a high pressure direct injection injector. In engines that utilize a low pressure indirect mechanical injector, a fuel pump supplies timed fuel pressure pulses. Within the injector, pressure builds behind a spring holding a needle valve closed until the spring compresses allowing the needle valve to open, thus releasing fuel. The injector spring rate and pump timing controls the fuel injection. In contrast, when a high pressure electronically-controlled direct injector is used, a solenoid or piezoelectric stack, for example, is used to actuate a needle valve when the engine control unit switches current to energize the injector. No fuel pump timing is required. Such a system is capable of multiple injections per firing event, and atomizes fuel much better than the low pressure indirect mechanical injector arrangement. Mixing and combustion are able to occur in the combustion chamber. That is, no pre-chamber is required. As compared to lower pressure injectors, high pressure injectors can help result in high atomization of fuel leaving the nozzle 13, improved mixing and fuel ignition, and cleaner combustion, without the need for a pre-chamber or the use of relatively high compression ratios.

In this embodiment, the heavy fuel oil is supplied to the injector 11 using an electronically controlled high pressure fuel pump, which pressurizes a reservoir (rail) that in turn feeds high pressure fuel to the injector 11 on demand via the supply 19. This system is generically known as common rail. In a variation to this embodiment, a cam may actuate a high pressure pumping chamber in the injector 11. In this embodiment, fuel is delivered to the injector 11 at a pressure of between 250 bar and 1,500 bar. In other embodiments, the pressure may be up to about 3,000 bar. These type of high pressure systems enable multi-point fuel injection. That is, the injector 11 is able to respond fast enough to deliver multiple fuel injections into the combustion chamber 8 during a single cylinder compression event.

In this embodiment, the engine has only one injector 11 with a nozzle 13 that is positioned within the combustion chamber 8, but in other embodiments there may be more than one injector 11 with a nozzle 13 positioned within the combustion chamber 8.

The engine also comprises the heater 18 to heat the combustion chamber 8. At least a portion of the heater 18 is positioned within the combustion chamber 8. At any time during engine operation, the heater 18 is used as a heavy fuel oil ignition aid when the duty of the engine does not provide sufficient heating from the engine's compression to cleanly ignite the heavy fuel oil. That is, heat emitted by the heater 18 in use adds energy to the compression ignition process, so as to help lower the compression ratio required for ignition of the heavy fuel oil.

In this embodiment, the heater 18 comprises a glow plug. In other embodiments, the heater 18 may be a different type of, optionally electrically-powered, heater. The heater 18 of this example projects into the combustion chamber 8 from the closed end 2 of the cylinder 1. More specifically, FIG. 1 shows that the heater 18 projects into the combustion chamber 8 from the closed end 2 and along an axis that is oblique to the central axis of the cylinder 1. In other embodiments, the orientation and location of the heater 18 may be different to that shown, to aid the combustion geometry and package envelope of the engine. For example, in some examples, the heater 18 may project into the combustion chamber 8 along an axis that is parallel or coincident with the central axis of the cylinder 1.

In this example, the heater 18 is fixed to a heater mount 20 at the closed end 2 of the cylinder 1, so as to be held by the mount 20 and located in the combustion chamber 8. The heater 18 is held by the mount 20 so as to extend through an opening 21 in the closed end 2 of the cylinder 1 to locate the heater 18 in the combustion chamber 8 in the position shown in FIG. 1. The heater 18 is fixed relative to the cylinder 1 to locate the heater 18 in a fixed position that is within the combustion chamber 8 throughout the engine cycle.

The engine comprises an interface 22 for connecting the heater 18 to a power source (not shown) when the heater 18 is held by the heater mount 20. In this embodiment, the power source is an electrical power source, such as a battery or an alternator or other form of electrical generator. In other embodiments, the power source may be other than electrical.

The engine comprises a controller 30 to control the heater 18, when the heater 18 is in place and held by the heater mount 20. In this embodiment, the controller 30 is to control the heater 18 to heat the combustion chamber 8 when the controller 30 determines that a temperature of the combustion chamber 8 has fallen below a threshold temperature during reciprocation of the piston 3 within the cylinder 1, i.e. during operation of the engine. Accordingly, the heater 18 is operated to keep the temperature of the combustion chamber 8 at or above the threshold temperature, to aid compression ignition of the heavy fuel oil. Such maintenance of the temperature may be achieved by the controller 30 turning the heater 18 on and off, or by the controller 30 reducing and increasing the temperature of the heater 18 as required but without turning the heater 18 off completely.

The controller 30 of this embodiment comprises an engine control unit (ECU) comprising a non-transitory machine-readable storage medium. The storage medium stores instructions that, when executed by the controller 30, cause the controller 30 to determine whether the temperature of the combustion chamber 8 has fallen below the threshold temperature during reciprocation of the piston 3 within the cylinder 1, and to control the heater 18 to heat the combustion chamber 8 when the controller 30 determines that the temperature has indeed so fallen.

In this embodiment, the engine includes a sensor 40 to detect a characteristic indicative of the temperature of the combustion chamber 8 during reciprocation of the piston 3 within the cylinder 1, and to output a signal in dependence on the characteristic detected. The controller 30 is configured to receive the signal and to determine whether the temperature of the combustion chamber 8 has fallen below the threshold temperature during reciprocation of the piston 3 within the cylinder 1 on the basis of the signal.

The sensor 40 of this embodiment is a temperature sensor 40 in the cylinder head 2. The sensor 40 is located so as to be heated by heat radiated from the combustion chamber 8 in use. The temperature measured by the sensor 40 is thus the temperature of the portion of the head 2 in which the sensor 40 is located. Such a temperature of the head portion is indicative of the temperature of the combustion chamber 8, even if not equal to the instantaneous temperature of the combustion chamber 8. In other embodiments, the sensor 40 may be to detect a different characteristic that is indicative of the temperature of the combustion chamber 8 during reciprocation of the piston 3 within the cylinder 1.

In this embodiment, on the basis of the signal from the sensor 40, the controller 30 is to control the heater 18 by way of pulse width modulation (PWM), so as to enable a varied duty cycle that is dependent on the temperature of the combustion chamber 8. In some embodiments, the controller 30 may control the heater 18 on the basis of further signals received by the controller 30 from control sensors fitted to the engine, such as any one or more of: engine speed, rail pressure, ambient temperature of the ECU, and engine water temperature. The control of the heater 18 may additionally or alternatively depend on the air/fuel ratio. This ratio may be determined based on the output of an oxygen sensor, or lambda sensor, configured to analyses the exhaust gas emitted through one of the exhaust ports 10, in combination with one or more sensors to sense engine speed, torque, combustion pressure, intake mass flow rate, intake pressure, intake temperature, exhaust temperature, exhaust pressure, and the like.

FIGS. 2(*a*) to 2(*d*) illustrate the operation of the engine of FIG. 1 over one complete crankshaft rotation. Specifically, FIGS. 2(*a*) to 2(*d*) illustrate the positions of the piston 3 at event increments. Some of the features and reference numerals used in FIG. 1 are omitted from FIGS. 2(*a*) to 2(*d*) for clarity.

FIG. 2(*a*) shows the engine at a crankshaft position of 0° (arbitrarily defined as TDC). At this position, the piston 3 and the closed end 2 of the cylinder 1 are at their point of closest approach. At approximately this angle of crankshaft rotation, in the exemplified direct-injection engine, a heavy fuel oil charge would be injected from the injector 11 directly into the combustion chamber 8 and combustion therein would begin. At this point, the intake and exhaust ports 9, 10 of the cylinder 1 are completely closed by the piston skirt 3.

In FIG. 2(*b*), the piston 3 and the closed end 2 of the cylinder 1 have moved apart, and the power stroke is substantially completed. The piston 3 has moved to open the exhaust ports 10, while the intake ports 9 remain closed. In this "blowdown" condition, some of the kinetic energy of the expanding gases from the combustion chamber 8 can be recovered externally if desired by a turbocharger ("pulse" turbocharging), for example compressing the next intake charge.

In this embodiment, the crankcase is sealed by a reed valve 16, and thus the gas in the crankcase is compressed by the piston 3 reducing the crankcase volume as the piston 3 moves away from TDC. This compressed gas is introduced to the combustion chamber 8 as the next intake charge, as described below. In some embodiments, the intake charge may be crankcase-scavenged by the use of ports opened and closed by movement of the piston 3 or by the use of valves actuated to time the entry of the charge into the crankcase to allow the piston to compress it as it moves away from TDC. Crankcase scavenging could also be supplemented or replaced by an external supercharger.

In FIG. 2(*c*), the piston 3 and the closed end 2 of the cylinder 1 continue to move apart, so that the piston 3 opens the intake ports 9 while keeping the exhaust ports 10 open. The compressed intake charge is now able to pass from the crankcase, through the intake ports 9 and into the combustion chamber 8 to help drive exhaust gases from the combustion chamber 8 via the exhaust ports 10, thus scavenging the combustion chamber 8.

In other embodiments, the exhaust port(s) 10 may open after and/or close before the intake port(s) 9 open/close. It may also be desirable in some applications for the port timing to be asymmetric, for example by using a valve to control the opening and closing of the intake and exhaust ports 9, 10.

In FIG. 2(*d*), the piston 3 has passed BDC, and both the intake ports 9 and the exhaust ports 10 are closed by the piston 3. The gas in the cylinder 1 is being compressed as the piston approached TDC, as the piston 3 is nears the end of the compression stroke and the "squish" phase is beginning. In this embodiment, the motion of the piston 3 towards TDC increases the volume in the sealed crankcase, thus opening the reed valve 16 and drawing air into the crankcase. Note that, because the crankcase is sealed, bearing(s) holding the crankshaft 5 are not pressure fed with oil. Therefore, a mist of oil is introduced to the intake air via a lubrication path 17, to lubricate the bearing(s). Employing this type of total loss lubrication system yields an engine that can be used in any orientation without lubrication issues. In the case of a heavy fuel oil engine, it is also possible to use the heavy fuel oil to lubricate the engine, thus yielding a single fluid engine with no service required for the lubrication system. Accordingly, in this example, the lubrication path 17 and the injector 11 are fluidly connected to a common supply of the heavy fuel oil. In some embodiments, the provision of a single fluid engine with a total loss lubrication oil system could yield an engine that requires little or no servicing, and is more environmentally friendly due to not having to recycle the lubrication oil.

The piston 3 then returns to the TDC position (FIG. 2(*a*)), where the piston 3 and the closed end 2 of the cylinder 1 are again at their position of closest approach. During this movement, the "squish" phase continues, causing intensifying gas motions that are at their most intense at TDC when the combustion chamber 8 most nearly resembles a toroid and is of minimum volume. At this point, multiple radial fuel sprays emanate from the central fuel injector 11, reaching almost all of the available air and causing very efficient combustion. Injection need not commence exactly at minimum volume and in some embodiments injection timing may change as a function of speed and/or load.

During the above-described reciprocation of the piston 3 within the cylinder 1, and on the basis of an output of the sensor 40, if the controller 30 determines that the temperature of the combustion chamber 8 has fallen below the threshold temperature, the controller 30 controls the heater 18 to supplement the heat generated by engine compression to help compression-ignite the fuel oil.

In some embodiments, the engine has a power output of up to 150 horsepower, such as between 10 and 120 horsepower, between 25 and 75 horsepower or between 30 horsepower and 60 horsepower. In some embodiments, the engine has a power output of between about 5 and 30 horsepower per cylinder, or between 10 and 20 horsepower per cylinder. In some embodiments, such as those with six or eight cylinders, the power output could be higher, such as up to but not limited to 300 horsepower.

Embodiments of the present invention may provide two-stroke internal combustion engines that are compact with a high ratio of power output to weight, avoid spark plug fouling, and offer oil fuel efficiency, clean oil fuel burn and oil fuel safety.

By using piston porting rather than, for example, poppet valves, the engine may have a simpler construction and less mass, as for example camshafts and discrete movable valves are not required. Compression ignition may yield good combustion. Crankcase scavenging, when used, may yield a reduction in parasitic losses and avoid the weight of external compressors. A dry crankcase, when used, may yield a simple lightweight oil system and no oil-to-cylinder ingress problems that may be associated with piston ported wet sump engines.

The specific angles and timings depend on the crankshaft geometries and port sizes and locations; the above description is intended solely to illustrate the concepts of the invention.

The skilled person will appreciate that various modification to the specifically described embodiments are possible without departing from the invention.

What is claimed is:

1. A piston ported two-stroke compression ignition internal combustion engine comprising:

a cylinder, a cylinder head defining a fixed closed end of the cylinder, and a piston for reciprocation within the cylinder, wherein the closed end of the cylinder and the piston together define a combustion chamber therebetween;

at least one heater to heat the combustion chamber;

a sensor mounted in the cylinder head to detect a characteristic indicative of a temperature of the combustion chamber during reciprocation of the piston within the cylinder, and to output a signal in dependence on the characteristic detected; and a controller to:

determine whether the temperature of the combustion chamber has fallen below, or is at or above, a threshold temperature, during reciprocation of the piston within the cylinder, on the basis of the signal outputted by the sensor;

increase a temperature of the heater to heat the combustion chamber, when the controller determines that the temperature of the combustion chamber has fallen below the threshold temperature during reciprocation of the piston within the cylinder; and reduce the temperature of the heater when the controller determines that the temperature of the combustion chamber is at or above the threshold temperature during reciprocation of the piston within the cylinder.

2. The internal combustion engine according to claim 1, wherein the heater projects into the combustion chamber from the closed end of the cylinder.

3. The internal combustion engine according to claim 1, wherein the heater is an electrically powered heater.

4. The internal combustion engine according to claim 1, wherein the heater comprises a glow plug.

5. The internal combustion engine according to claim 1, wherein at least a portion of the heater is positioned within the combustion chamber.

6. The internal combustion engine according to claim 5, comprising at least one heavy fuel oil injector, the injector having a nozzle that is positioned within the combustion chamber and through which heavy fuel oil is expelled directly into the combustion chamber in use.

7. The internal combustion engine according to claim 1 comprising:

a crankshaft held by at least one bearing and operatively connected to the piston so as to be driven by reciprocating motion of the piston; and at least one lubrication path via which heavy fuel oil is able to travel to lubricate the at least one bearing in use.

8. The internal combustion engine according to claim 1, comprising plural cylinders.

9. The internal combustion engine according to claim 1, wherein the engine is an outboard marine engine.

10. The internal combustion engine according to claim 1, wherein, on the basis of the signal, the controller is to control the heater by way of pulse width modulation, so as to enable a varied duty cycle that is dependent on the temperature of the combustion chamber.

11. The internal combustion engine according to claim 1, wherein the internal combustion engine is free of poppet valves.

12. The internal combustion engine according to claim 1, wherein the cylinder comprises:

at least one intake port extending through a wall of the cylinder;

at least one exhaust port extending through the wall of the cylinder;

a crankshaft held by at least one bearing and operatively connected to the piston so as to be driven by reciprocating motion of the piston; and a crankcase encasing the crankshaft;

wherein the piston is moveable away from the closed end of the cylinder to open the at least one intake port, such that a compressed intake charge is able to pass from the crankcase through the at least one intake port and into the combustion chamber to scavenge the combustion chamber.

13. A piston ported two-stroke compression ignition internal combustion engine comprising:

a cylinder, a cylinder head defining a fixed closed end of the cylinder, and a piston for reciprocation within the cylinder, wherein the closed end of the cylinder and the piston together define a combustion chamber therebetween;

at least one heater mount for holding a heater to heat the combustion chamber;

a sensor mount in the cylinder head for mounting a sensor to detect a characteristic indicative of a temperature of the combustion chamber during reciprocation of the piston within the cylinder, and to output a signal in dependence on the characteristic detected; and a controller to:

determine whether the temperature of the combustion chamber has fallen below, or is at or above, a threshold temperature during reciprocation of the piston within the cylinder, on the basis of the signal outputted by the sensor;

increase a temperature of the heater, when the heater is held by the heater mount, to heat the combustion chamber when the controller determines that the temperature of the combustion chamber has fallen below the threshold temperature during reciprocation of the piston within the cylinder; and reduce the temperature of the heater, when the heater is held by the heater mount and when the controller determines that the temperature of the combustion chamber is at or above the threshold temperature during reciprocation of the piston within the cylinder.

14. The internal combustion engine according to claim 13, comprising an interface for connecting the heater to a power source when the heater is held by the heater mount;

wherein the at least one heater mount is for holding the heater to heat the combustion chamber with at least a portion of the heater positioned within the combustion chamber.

15. The internal combustion engine according to claim 11 comprising:

a crankshaft held by at least one bearing and operatively connected to the piston so as to be driven by reciprocating motion of the piston; and at least one lubrication path via which heavy fuel oil is able to travel to lubricate the at least one bearing in use.

16. The internal combustion engine according to claim 13, comprising plural cylinders.

17. The internal combustion engine according to claim 13, wherein the engine is an outboard marine engine.

18. A non-transitory machine-readable storage medium storing instructions that, when executed by a controller of a piston ported two-stroke compression ignition internal combustion engine, the engine comprising a cylinder, a cylinder head defining a fixed closed end of the cylinder, and a piston for reciprocation within the cylinder, wherein the closed end of the cylinder and the piston together define a combustion chamber therebetween, and at least one heater to heat the combustion chamber, and a sensor mounted in the cylinder head to detect a characteristic indicative of a temperature of the combustion chamber during reciprocation of the piston within the cylinder, and to output a signal in dependence on the characteristic detected; and the controller to control the heater to heat the combustion chamber, cause the controller to:

determine whether a temperature of the combustion chamber has fallen below or is at or above, a threshold temperature during reciprocation of the piston within the cylinder, on the basis of the signal outputted by the sensor;

increase a temperature of the heater to heat the combustion chamber, when the controller determines that the temperature of the combustion chamber has fallen below the threshold temperature during reciprocation of the piston within the cylinder; and reduce the temperature of the heater when the controller determines that the temperature of the combustion chamber is at or above the threshold temperature during reciprocation of the piston within the cylinder.

19. An engine control unit comprising a non-transitory machine-readable storage medium, the non-transitory machine-readable storage medium storing instructions that, when executed by a controller of a piston ported two-stroke compression ignition internal combustion engine, the engine comprising a cylinder, a cylinder head defining a fixed closed end of the cylinder, and a piston for reciprocation within the cylinder, wherein the closed end of the cylinder and the piston together define a combustion chamber therebetween, and at least one heater to heat the combustion chamber, and a sensor mounted in the cylinder head to detect a characteristic indicative of a temperature of the combustion chamber during reciprocation of the piston within the cylinder, and to output a signal in dependence on the characteristic detected; and the controller to control the heater to heat the combustion chamber, cause the controller to:

determine whether a temperature of the combustion chamber has fallen below or is at or above, a threshold temperature during reciprocation of the piston within the cylinder, on the basis of the signal outputted by the sensor;

increase a temperature of the heater to heat the combustion chamber, when the controller determines that the temperature of the combustion chamber has fallen below the threshold temperature during reciprocation of the piston within the cylinder; and reduce the temperature of the heater when the controller determines that the temperature of the combustion chamber is at or above the threshold temperature during reciprocation of the piston within the cylinder.

* * * * *